United States Patent [19]

Wakim

[11] 3,986,966

[45] Oct. 19, 1976

[54] COSULFURIZED PRODUCTS OF HIGH IODINE VALVE TRIGLYCERIDE AND NONWAX ESTER OF MONOETHENOID FATTY ACID AS LUBRICANT ADDITIVES

[75] Inventor: Jamil M. Wakim, Burlington, Canada

[73] Assignee: Shell Oil Company, Houston, Tex.

[22] Filed: Mar. 17, 1975

[21] Appl. No.: 559,096

Related U.S. Application Data

[63] Continuation-in-part of Ser. No. 321,614, Jan. 8, 1973, abandoned.

[30] Foreign Application Priority Data

Jan. 10, 1972 Canada ..... 132071

[52] U.S. Cl. ..... 252/48.6

[51] Int. Cl.[2] ..... C10M 1/38; C10M 3/32; C10M 5/28; C10M 7/36

[58] Field of Search ..... 252/48.6

[56] References Cited

UNITED STATES PATENTS

| | | | |
|---|---|---|---|
| 3,740,333 | 6/1973 | Hutchinson et al. | 252/48.6 |
| 3,850,825 | 11/1974 | Vienna et al. | 252/48.6 |

*Primary Examiner*—Delbert E. Gantz
*Assistant Examiner*—I. Vaughn
*Attorney, Agent, or Firm*—Henry C. Geller

[57] ABSTRACT

A cosulfurized product of a mixture of (a) a triglyceride having an iodine value greater than 80, preferably rapeseed oil, and (b) nonwax ester comprising the methyl ester of a fatty acid having from 18 to 22 carbon atoms or a mixture thereof, said fatty acid being predominantly monoethylenically unsaturated, has excellent extreme pressure and low temperature properties and is an effective substitute for sulfurized sperm oil.

10 Claims, 1 Drawing Figure

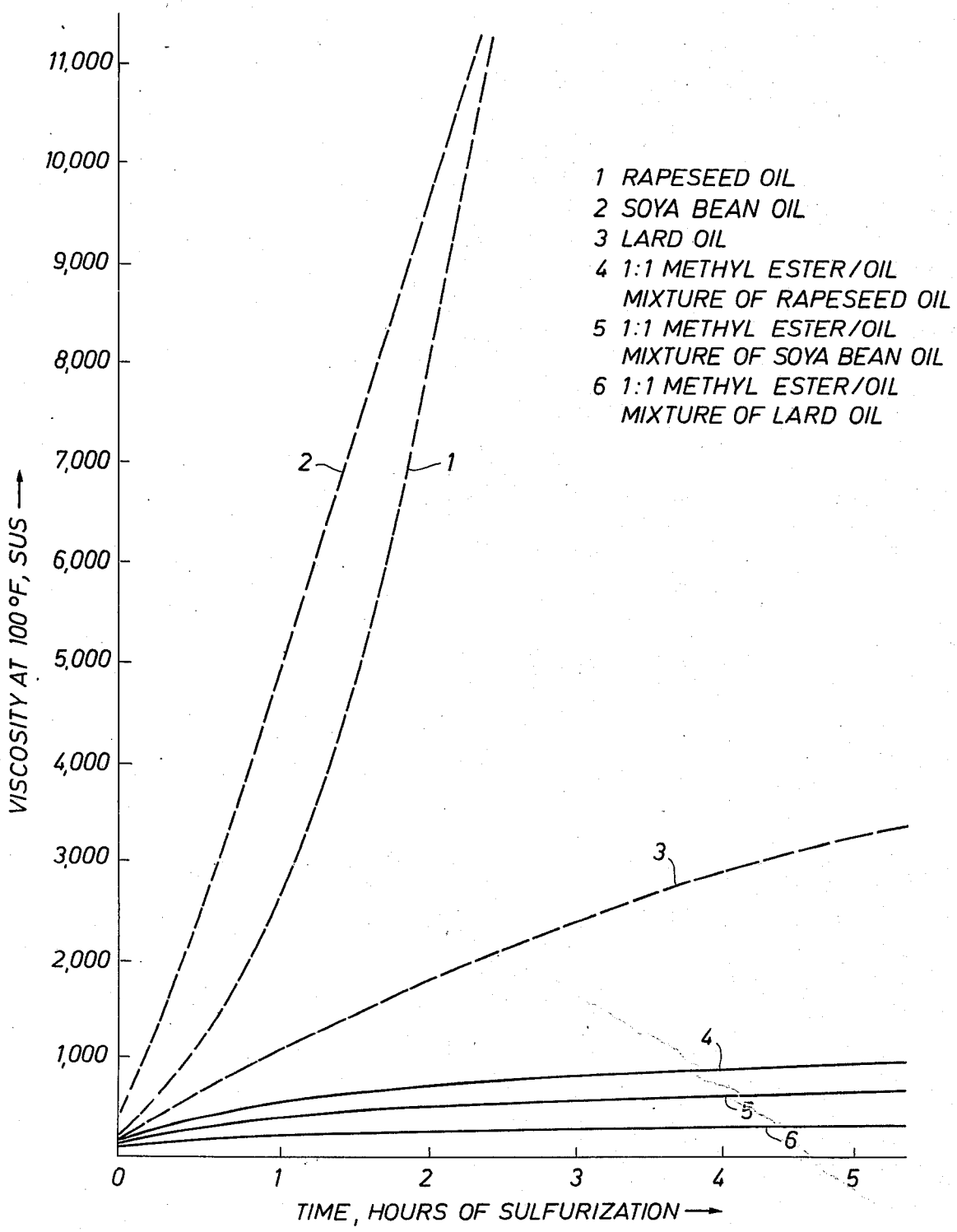
11,000
10,000
9,000
8,000
7,000
6,000
5,000
4,000
3,000
2,000
1,000
VISCOSITY AT 100°F, SUS
0
1
2
3
4
5
TIME, HOURS OF SULFURIZATION
1 RAPESEED OIL
2 SOYA BEAN OIL
3 LARD OIL
4 1:1 METHYL ESTER/OIL MIXTURE OF RAPESEED OIL
5 1:1 METHYL ESTER/OIL MIXTURE OF SOYA BEAN OIL
6 1:1 METHYL ESTER/OIL MIXTURE OF LARD OIL

COSULFURIZED PRODUCTS OF HIGH IODINE VALVE TRIGLYCERIDE AND NONWAX ESTER OF MONOETHENOID FATTY ACID AS LUBRICANT ADDITIVES

CROSS-REFERENCE TO RELATED APPLICATIONS

This is a continuation-in-part of applicant's copending application Ser. No. 321,614, filed Jan. 8, 1973, now abandoned.

BACKGROUND OF THE INVENTION

A well-known and very effective extreme pressure additive for lubricating oil is sulfurized sperm oil. The supplies of sperm oil, however, are dwindling in view of whale protection laws. Various materials are being proffered as sperm oil substitutes. One such group of compositions as disclosed in U.S. Pat. No. 3,740,333 are blends of triglycerides and wax esters derived from predominantly $C_{18-22}$ unsaturated acids and $C_{10-16}$ saturated alcohols; the compositions are disclosed as useful per se and in the sulfurized form. The triglycerides disclosed are those derived from plants and animals and have iodine values between about 50 and 120, with lard oil having an iodine value between about 65 and 80 being a preferred triglyceride.

Lard, a material of low iodine value, may be the equivalent of oils having an iodine value greater than 80, for example, vegetable oils such as rapeseed oil or soya bean oil, in the unsulfurized state; however, upon sulfurization, it has been found that lard oil is not the equivalent of oils having an iodine value greater than 80, e.g., vegetable oils, in that lard oil can be sulfurized to a product having a low viscosity and high solubility in mineral oil. Sulfurization of oils having an iodine value greater than 80 produces a high viscosity, unworkable semi-solid which is only sparingly soluble in hydrocarbon lubricating oils.

The above-mentioned U.S. Pat. No. 3,740,333 discloses that, in the blends of triglyceride and wax ester, alcohols employed to obtain the wax esters are saturated primary alcohols of about 6 to 20 carbon atoms, with best results obtained when the alcohol contains about 10 to 16 carbon atoms. If too low a molecular weight alcohol is used, the resulting blends have high flash points and low viscosities and are less desirable.

SUMMARY OF THE INVENTION

It has now been found that particular compositions, in contradistinction to physical mixtures, of cosulfurized products from the sulfurization of mixtures of triglyceride having an iodine value greater than 80 – for example, vegetable oils such as rapeseed oil or soya bean oil – and specific nonwax esters comprising methyl esters of predominantly monoethenoid fatty acid of 18 to 22 carbon atoms, in lubricant oil compositions not only have advantageous properties without harmful effect on flash point or load-carrying capacity but also in some uses unexpectedly perform better than similar compositions produced from wax esters, i.e., from esters of higher molecular weight alcohols.

Accordingly, the invention provides a particular lubricant composition comprising a lubricating oil and from about 0.1 to about 20% by weight of a cosulfurized mixture of (a) a triglyceride having an iodine value greater than 80 and (b) nonwax ester comprising the methyl ester of a fatty acid having from 18 to 22 carbon atoms or a mixture thereof, said fatty acid being predominantly monoethylenically unsaturated, wherein the sulfur content of the cosulfurized mixture of (a) and (b) is from about 1 to about 40% by weight and wherein the weight ratio of (a):(b) is in the range of from about 0.1:1 to about 10:1.

For purposes of this specification and claims the term predominantly is used to mean over 50% by weight.

DESCRIPTION OF PREFERRED EMBODIMENTS

The triglyceride employed in the mixture, which is cosulfurized to produce the lubricant additive product of the invention, is critically a triglyceride having an iodine value greater than 80. Such triglycerides are in general vegetable oils but are not necessarily so in that iodine value is a measure of degree of unsaturation and highly unsaturated fatty oils which are not vegetable oils are also useful. Thus, the upper limit of iodine value is not critical, as is the lower limit (cf. hereinafter the disclosure in Example 4); the upper limit of iodine value may be any value depending on the unsaturation of the triglyceride, but as a practical matter will preferably be about 200, and most preferably about 180. Illustrative of the triglycerides suitably employed are rapeseed oil, soya been oil, peanut oil, herring oil, safflower oil, sunflowerseed oil, cottonseed oil, and the like. Preferred triglycerides include rapeseed oil and soya been oil; a particularly preferred triglyceride is rapeseed oil. Optionally the rapeseed oil may be a refined rapeseed oil, for example, by treating the degummed oil with aqueous NaOH to reduce the free acid content, e.g., to about 0.15%w, or by any other conventional refining technique. However, unrefined rapeseed oil is suitably employed in the mixture.

The other component employed in the mixture, which is cosulfurized to produce the lubricant additive of the invention, is nonwax ester comprising the methyl ester of a fatty acid having from 18 to 22 carbon atoms or a mixture thereof, said fatty acid being predominantly monoethylenically unsaturated. Most effective for purposes of the suitable compositions of the invention are the methyl esters from fatty acids made up predominantly of 18 to 22 carbon atoms with only a minor portion of fatty acid of molecular weight above and below these ranges. In some instances predominantly a single fatty acid of particular number of carbon atoms, such as fatty acid of 18 carbon atoms, is very suitable. The nonwax esters are easily obtainable by esterification of a suitable fatty acid or mixture of fatty acids with methanol. For example, pure or commercial oleic acid may be esterified with methanol to produce suitable nonwax esters. Preferably, the nonwax esters are prepared by alcoholysis with methanol of a triglyceride, which may be the triglyceride employed in the mixture or a different one therefrom. A particularly preferred nonwax ester suitable for use in the mixture to produce the ultimate product of the invention is prepared by alcoholysis of rapeseed oil with methanol. This can be accomplished by heating and stirring rapeseed oil with excess methanol in the presence of a catalyst, such as sodium alkoxide, under anhydrous conditions. Glycerol is then allowed to settle after which the layers are separated. The upper layer contains the methyl esters which can be separated from the excess methanol by distillation of the latter.

The weight ratio of triglyceride having an iodine value greater than 80 to the nonwax ester in the mixture can vary between wide limits, suitably in the range from about 0.1:1 to about 10:1, and preferably from about 0.3:1 to about 3:1.

Cosulfurization of the said mixture of triglyceride and nonwax ester is carried out by conventional techniques well-known in the art, for example, by heating with sulfur. The sulfurization is preferably carried out at a temperature in the range of from about 320° to about 390° F and most preferably at a temperature in the range of from about 345° to about 355° F.

The sulfur content of the cosulfurized product is suitably between about 1 and about 40% by weight, preferably between about 5 and about 30% and most preferably about 10% by weight. It is obvious to those skilled in the art that the sulfur can be active and/or inactive depending on the method of preparation and the amount of sulfur incorporated in the cosulfurized product. The sulfur content desirable is also dependent upon the use to which the lubricant containing the cosulfurized product is put. For example, in gear oils where staining of copper is objectionable, it is preferred to use cosulfurized products that contain about 10% sulfur, i.e., no active sulfur. As a further optional processing step to insure that even the 10% sulfur-containing product is not harmful to metal, the cosulfurized product is air blown. However, cosulfurized products with a high content of active sulfur which are employed in metal cutting fluids, or such applications, need not be air blown since the presence of active sulfur is not objectionable in those uses.

The amount of the cosulfurized product suitably employed in the lubricant composition of the invention may be between about 0.1 and about 20% by weight and preferably, between about 1 and about 10% by weight.

The base oil of the lubricant composition is, preferably, a mineral lubricating oil although synthetic hydrocarbon lubricating oils and other synthetic lubricating oils, such as ester lubricating oils as well as mixtures thereof, e.g., mixtures of mineral and synthetic lubricating oils, can also be used provided that the desired proportion of the cosulfurized product is soluble in the base oil in question.

The mineral oils include HVI (high viscosity index) oils, Bright Stock, Bright Stock extract as well as MVI and LVI oils, i.e., the viscosity index of these oils can vary from −150 to 150. The 210° F viscosities of these oils can vary from 2 to 140 centistokes. Mixtures of these oils are also suitably employed.

Other additives may be present in the lubricant composition. Suitable other additives are anti-oxidants, anti-corrosive agents, anti-foam agents, pour point depressants, viscosity index improvers and additional anti-wear or load-carrying additives.

In fully formulated tableway lubricants the cosulfurized product additives of the invention showed effective anti-slick-slip properties. They also showed a good compatability with other additives in these lubricants as well as in gear oils.

The present lubricant compositions may also be thickened to a gel or to a grease using, e.g., soap-, waterproofed clay- or organic thickeners.

EXAMPLE 1

(x) One mole of rapeseed oil (933 g) was heated with stirring to about 30° C and 4.8 moles methanol (154 g) containing less than 0.1%w water to which had been added 0.05 mole sodium (1.23 g), were added gradually. The mixture was heated with stirring to 75° ± 5° C and kept at this temperature for one hour. Glycerol was then allowed to settle and the layers formed were separated. The upper layer contained the methyl esters, excess methanol and the sodium compounds, the lower layer contained glycerol.

The upper layer was neutralized with concentrated HC1. After vigorous stirring alumina was added to dry the mixture and netralize any excess HC1. The mixture was filtered and the excess methanol was distilled off. The yield of the remaining methyl esters was 96%. They were analyzed and the fatty acid moieties showed the following composition:

| Fatty acid | % by weight |
|---|---|
| $C_{16}$ | 4.2 |
| $C_{18}$ | 36.9 |
| $C_{20}$ | 12.0 |
| $C_{22}$ | 44.4 |
| $C_{24}$ | 0.8 |
| Other acids | 1.7 |
| Total saturated | 7.0 |
| Total monoethylenic | 71.0 |
| Total polyethylenic | 22.0 |

The esters thus prepared were mixed with rapeseed oil and subsequently cosulfurized by heating with sulfur.

The following mixtures were prepared:

TABLE I

| | weight ratio rapeseed oil/methyl esters | | % w s |
|---|---|---|---|
| A | 50/50 | (1:1) | 10.0 |
| B | 40/60 | (0.67:1) | 9.1 |
| C | 70/30 | (2.33:1) | 9.1 |
| D | 35/65 | (0.63:1) | 9.1 |
| E | 1/3* | (0.33:1) | 10.0 |

*mole ratio rapeseed oil/methyl oleate.

(y) Similarly, another natural rapeseed oil called Canbra rapeseed oil was treated with methanol as in (x) above yielding methyl esters of fatty acid moieties showing the following composition:

| Fatty acid | % by weight |
|---|---|
| Saturated | |
| $C_{16}$ | 5 |
| $C_{18}$ | 2 |
| Unsaturated | |
| $C_{18}$, monoethylenic | 63 |
| $C_{18}$, diethylenic | 20 |
| $C_{18}$, triethylenic | 9 |
| $>C_{18}$ | 1 |

EXAMPLE 2

Same as in Example 1 except that the sodium compounds were not removed from the esters. The esters were mixed with the rapeseed oil and the mixture was cosulfurized and filtered.

EXAMPLE 3

The anti-wear, extreme pressure and Cu-corrosion properties of the present additive mixtures were investigated and compared with sulfurized sperm oil containing 9.25% S. The base oil was a mixture of 66%w HVI (high viscosity index) mineral vacuum distilled lubricating oil and 34%w HVI Bright Stock.

The results are indicated in Table II (proportions are in %w):

TABLE II

| | Sulfurized sperm oil | | | A | | B | C | D | E | |
|---|---|---|---|---|---|---|---|---|---|---|
| Proportion | 5 | 8 | 10 | 5 | 10 | 5 | 5 | 5 | 2.5 | 5 |
| Cu-corrosion (a) | | | la | | lb | | | | | |
| Timken OK Load (kg) (b) | 18 | 22.5 | 27 | 25 | 25 | 27 | 20 | 22.5 | 18 | 18 |
| 4 Ball weld Load (kg) (c) | <212 | | | 224 | | | | | | |

(a) Cu-corrosion is performed as described in ASTM Standard Test Method D 130-65. A polished copper strip is immersed in a sample of oil and heated at a temperature of 212° F (100° C) for a period of 3 hours. At the end of this period the copper strip is removed, washed and compared with ASTM Copper Strip Corrosion standards.

(b) Timken OK Load is determined according to ASTM Tentative Test Method D 2509-66T. The Timken tester is operated with a steel test cup rotating against a steel test block. The rotating speed is 405.88 ± 2.45 ft/min. An oil is used instead of the grease mentioned in the test method. The maximum load which can be applied without rupturing the lubricant film and causing abrasion between the rotating cup and the stationary block is the Timken OK Load.

(c) 4-Ball Weld Load is determined in accordance with ASTM Tentative Test Method D 2596-67T. The tester is operated with one steel ball under load rotating against three steel balls held stationary in the form of a cradle. The rotating speed is 1770 ± 60 rpm. Lubricating oil is brought to 80 ± 15° F and then subjected to a series of tests of 10 sec. duration at increasing loads until welding occurs.

From Table II it follows that the present additives, in particular additive A, have excellent load-carrying properties.

In Table III the anti-oxidant properties of additive A are indicated.

TABLE III

| | RBOT Life minutes |
|---|---|
| Base oil (same as in Table II) | 20 |
| Base oil + 2% A | 170 |
| Base oil + 5% A | 310 |

RBOT stands for Rotating Bomb Oxidation Test and is performed in accordance with ASTM Standard Test Method D 2272-67. A test oil, water and copper catalyst coil, contained in a covered glass container, are placed in a bomb equipped with a pressure gauge. The bomb is charged with oxygen to a pressure of 90 psi, placed in a constant temperature bath set at 150° C, and rotated axially at 100 rpm at an angle of 30° from the horizontal. The time for the test oil to react with a given volume of oxygen is measured: completion of the time is indicated by pressure drop of 25 psi.

EXAMPLE 4

The following triglycerides and 1:1 by weight mixtures of triglycerides and methyl esters obtained from the alcoholysis of each triglyceride with methanol (by the procedure of Example 1 (x) above) were sulfurized by heating with 10% by weight of sulfur at a temperature of 350° F ± 5° over a time period indicated in the accompanying FIGURE:

| No. | Triglyceride or Triglyceride-Ester Mixture | Iodine Value of Representative Samples of Triglyceride |
|---|---|---|
| 1 | Rapeseed Oil | 81–140 |
| 2 | Soya Bean Oil | 120–141 |
| 3 | Lard Oil | 53–77 |
| 4 | 1:1 Methyl ester/oil mixture of Rapeseed Oil | 81–140 |
| 5 | 1:1 Methyl ester/oil mixture of Soya Bean Oil | 120–141 |
| 6 | 1:1 Methyl ester/oil mixtures of Lard Oil | 53–77 |

The viscosity of each of the above was determined over the time interval of sulfurization and plotted as shown in said FIGURE. It is apparent from curves numbered 1 and 2 that triglycerides illustrative of triglycerides of iodine value greater than 80, namely, rapeseed oil and soya bean oil, become polymerized to a rubber-like consistency and are only sparingly soluble in hydrocarbon lubricating oils. Curve number 3 shows that triglyceride of low iodine value, namely, lard oil, is sulfurized to a product of relatively low viscosity and high solubility in hydrocarbon lubricating oil. The triglycerides of iodine value greater than 80 can be sulfurized to low viscosity, hydrocarbon lubricating oil-soluble materials only when cosulfurized as methyl ester/-triglyceride mixture as shown by curves 4 and 5. Curve 6 indicates that cosulfurized product of methyl esters of lard oil admixed with lard oil, i.e., triglyceride of low iodine value, is similar in viscosity and solubility to the mixtures based on triglyceride of iodine value greater than 80 (curves 4 and 5) but the product (6) based on triglyceride of low iodine value is not the equivalent in properties or performance as can be seen from the data in Example 5 following.

EXAMPLE 5

A cosulfurized product was prepared from a 1:1 by weight mixture of each fatty triglyceride indicated in Table IV and its methyl esters. Table IV also describes some physical properties of the cosulfurized products and their performance properties as additive at 5.0% by weight in HVI, SAE 90 grade base lubricating oil. Both products were 100% soluble in the mineral oil. However, the product based on triglyceride of iodine value greater than 80 (rapeseed oil) has superior low temperature properties, as indicated by pour point value, compared to the product based on triglyceride of low iodine value (lard oil). When used in mineral lubricating oil the product based on triglyceride of iodine value greater than 80 demonstrates superior load-carrying capacity, as indicated by Load-Wear Index value and Timken OK Load value, compared to the product based on triglyceride of low iodine value.

TABLE IV

COMPARISON OF SULFURIZED FATTY OILS — METHYL ESTER MIXTURES

| | Sulfurized Methyl Ester/Oil Mixture | |
|---|---|---|
| | Rapeseed Oil | Lard Oil |
| Physical Properties | | |
| Iodine value | 81–140 | 53–77 |
| Pour Point, ° F | 0 | 40 |
| Sulfur, % wt | 9.3[a)] | 6.8[a)] |
| Performance at 5.0% wt in HVI, SAE 90 Base Oil | | |
| Solubility, % wt. of Additive | 100 | 100 |
| Timken OK Load, lbs. | 40 | 20 |
| Load-Wear Index | 47.7 | 37.0 |
| Rotary Bomb Oxidation Test, Min. | 250 | 150 |
| Copper Corrosion, ASTM D-130, 3 Hrs. at 212° F | 1a | 1a |

[a)]equivalent of 1 mol of sulfur per ethylenic double bond.

EXAMPLE 6

A cosulfurized product was prepared from a mixture of the triglyceride, rapeseed oil, (of Example 1 (y)) and each of two alkyl esters. The alkyl esters are alkyl oleates, produced from commercial oleic acid, which contains about 70% by weight of oleic acid, i.e., about 70% monoethylenically unsaturated $C_{18}$ fatty acid. The alkyl oleates employed are methyl oleate from methanol and $C_{14-15}$ alkyl oleate from a mixed $C_{14-15}$ alcohol. Table V describes some physical properties of the two cosulfurized products and their performance properties as additives at 5.0% by weight in HVI, SAE 90 grade base lubricating oil.

TABLE V

COSULFURIZED PRODUCTS FROM MIXTURES OF ALKYL OLEATES AND RAPESEED OIL

| | Methyl Oleate | $C_{14-15}$ Alkyl Oleate |
|---|---|---|
| Properties | | |
| Alcohol Chain Length | 1 | 14–15 |
| Fatty Oil | Rapeseed | Rapeseed |
| Ester/Oil Ratio, Wt. | 1.22:1 | 1.22:1 |
| Sulfur Content, % Wt. | 9.5 | 9.5 |
| Viscosity at 100° F, SUS | 773 | 2075 |
| Performance at 5.0% wt in HVI, SAE 90 Grade Base Oil[a)] | | |
| Viscosity at 210° F, Cs | 17.2 | 17.6 |
| Rotary Bomb Oxidation Test, Min. | 280 | 275 |
| C.O.C. Flash Point, ° F | 450 | 500 |
| Pour Point, ° F | 0 | 30 |
| Copper Corrosion, ASTM D-130, 3 Hrs. at 212° F | 1a | 1b |
| Load-Wear Index | 49.8 | 48.8 |
| 4-Ball Wear Scar, mm | 0.52 | 0.55 |
| Solubility (Appearance of Sol'n.) | Clear | Cloudy |

[a)]Pour Point of Base Oil = 0° F.

The above data demonstrate that, surprisingly, cosulfurized product made from a lower alkyl ester (methyl ester) and a triglyceride of iodine value greater than 80 (rapeseed oil) in comparison to a corresponding product based on a higher alkyl ester ($C_{14-15}$ alkyl ester) exhibits superior low temperature performance (cf. pour point values) in a lubricant blend with no harmful effect on flash point or load-carrying capacity. As a matter of fact, the improved low temperature flowability in the lubricant blend has been achieved not only without any sacrifice in load-carrying ability but with some gain therein (cf. load-wear index and 4-ball wear scar values). Additional advantage found with the methyl ester product is its complete solubility in mineral lubricating oil. The higher alkyl ester product produces a slightly cloudy solution in lubricating oil; such haze usually results in a precipitation or sludge formation on standing or with use.

EXAMPLE 7

Mineral lubricating oil having incorporated therein 7% by weight of the cosulfurized product of Example 6 made from methyl ester was thickened to a grease consistency of Grade 1 having a penetration at room temperature of 325° by use of a lithium soap, namely, lithium 12-hydroxystearate soap; this composition is designated (a) in Table VI. A corresponding composition, designated (b) in Table VI, was produced containing 7% by weight by the cosulfurized product of Example 6 made from $C_{14-15}$ alkyl ester. The two greases were subjected to temperatures of −30° F and −40° F and the following properties were obtained:

TABLE VI

LOW TEMPERATURE FLOW PROPERTIES OF MINERAL LUBRICATING OIL CONTAINING SULFURIZED ALKYL ESTER/RAPESEED OIL MIXTURE AND THICKENED TO GREASE consistency

| | Temperature | | | | | |
|---|---|---|---|---|---|---|
| | −30° F | | | −40° F | | |
| | | Ventmeter (lbs/in²) | | | Ventmeter (lbs/in²) | |
| Grease | Penetration Undisturbed | 30 sec. | 3 min | Penetration Undisturbed | 30 sec. | 3 min |
| (a) | 228 | 240 | 140 | 210 | 740 | 230 |

TABLE VI-continued

LOW TEMPERATURE FLOW PROPERTIES OF MINERAL LUBRICATING OIL CONTAINING SULFURIZED ALKYL ESTER/RAPESEED OIL MIXTURE AND THICKENED TO GREASE consistency

| | Temperature | | | | | |
|---|---|---|---|---|---|---|
| | −30° F | | | −40° F | | |
| | Penetration | Ventmeter (lbs/in²) | | Penetration | Ventmeter (lbs/in²) | |
| Grease | Undisturbed | 30 sec. | 3 min | Undisturbed | 30 sec. | 3 min |
| (b) | 187 | 640 | 210 | 182 | 1600 | 530 |

The above data indicate that the superior low temperature flow properties of the lubricant containing additive based on methyl ester, as compared to lubricant containing additive based on higher alkyl ester, accrued to grease produced therefrom. More particularly, the ventmeter data demonstrate that a lower force was required to push the same amount of grease based on methyl ester additive in the same time interval, thereby indicating a significant difference in pumpability of that grease compared to the corresponding grease based on the higher alkyl ester additive.

What is claimed is:

1. A lubricant composition comprising a lubricating oil and from about 0.1 to about 20% by weight on the composition of a cosulfurized mixture of (a) a triglyceride having an iodine value greater than 80 and (b) nonwax ester comprising the methyl ester of a fatty acid having from 18 to 22 carbon atoms or a mixture thereof, said fatty acid being predominantly monoethylenically unsaturated, wherein the sulfur content of the cosulfurized mixture of (a) and (b) is from about 1 to about 40% by weight and wherein the weight ratio of (a):(b) is in the range of from about 0.1:1 to about 10:1.

2. A composition according to claim 1 wherein said triglyceride has an iodine value no greater than about 200.

3. A composition according to claim 2 wherein said triglyceride has an iodine value no greater than about 180.

4. A composition according to claim 3 wherein said triglyceride is rapeseed oil.

5. A composition according to claim 4 wherein said nonwax ester is the methyl ester of rapeseed fatty acids.

6. A composition according to claim 4 wherein said nonwax ester is predominantly methyl oleate.

7. A composition according to claim 1 wherein the sulfur content of said cosulfurized mixture is from about 5 to about 30% by weight.

8. A composition according to claim 1 wherein said weight ratio of (a):(b) is in the range of from about 0.3:1 to about 3:1.

9. A composition according to claim 1 wherein said cosulfurized mixture is present in amount of from about 1 to about 10% by weight.

10. A composition according to claim 7 wherein the sulfur content of said cosulfurized mixture is about 10% by weight.

* * * * *